United States Patent [19]

Smith

[11] 4,177,439

[45] Dec. 4, 1979

[54] REED RELAY AND METHOD OF ASSEMBLY

[75] Inventor: Philip N. Smith, Cincinnati, Ohio

[73] Assignee: Standex International Corporation, Andover, Mass.

[21] Appl. No.: 881,697

[22] Filed: Feb. 27, 1978

[51] Int. Cl.[2] ..... H01H 51/27; H01H 11/00; H01H 1/66

[52] U.S. Cl. ..... 335/151; 29/602 R; 29/622; 335/202

[58] Field of Search ..... 335/112, 151, 152, 202; 29/602 R, 622

[56] References Cited

U.S. PATENT DOCUMENTS

| | | | |
|---|---|---|---|
| 3,171,918 | 3/1965 | Killion | 335/202 |
| 3,218,407 | 11/1965 | Bengtsson | 335/202 |
| 3,268,686 | 8/1966 | Wauer | 335/154 |
| 3,387,240 | 6/1968 | Koppensteiner | 335/153 |
| 3,434,079 | 3/1969 | Ege | 335/151 |
| 3,664,014 | 5/1972 | Peroni et al. | 29/622 |
| 3,928,829 | 12/1975 | Abrams | 335/151 |
| 3,940,722 | 2/1976 | Fox et al. | 335/151 |
| 3,993,970 | 11/1976 | Brownell | 335/152 X |
| 4,136,321 | 1/1979 | Smith | 335/151 |

*Primary Examiner*—Fred L. Braun
*Attorney, Agent, or Firm*—Wood, Herron & Evans

[57] ABSTRACT

A reed relay wherein a glass-enclosed switch is inserted into a hollow bobbin and a hinged tab is swung upwardly to provide a support shoulder for a lead projecting through the large opening of the bobbin. A housing has an internal shoulder at each end, the shoulders being engageable respectively with a preformed shoulder at one end of the bobbin and the shoulder provided by the hinged tab at the other end of the bobbin to clamp the leads between the bobbin and the housing. During assembly the hinged tab is forced upwardly by tooling which also provides a support about which the switch leads are bent through an angle of 90°.

12 Claims, 9 Drawing Figures

REED RELAY AND METHOD OF ASSEMBLY

This invention relates to a reed relay and a method of assembly.

Reed relays of the type to which the present invention is directed are well known in the art. In general, the reed relay consists of an elongated glass-encapsulated switch having leads projecting longitudinally from each end of the switch. The switch is inserted into a bobbin which has an electrically-conductive coil wound upon it, the ends of the coil being connected to coil terminals which are secured to the bobbin. The coil terminals usually extend transversely to the longitudinal axis of the bobbin and project from each side of the bobbin. At one side, where the ends of the coil are connected to the coil terminals thereby forming horns, the projecting terminals or horns are bent through 90° to lie along the surface of the bobbin.

The glass which encapsulates the switch tends to be somewhat fragile and the joint between the switch leads and glass is subject to breakage if roughly handled. It is therefore desirable to capture and immobilize the switch leads as well as to maintain the horns or terminals to which the coil ends are connected out of contact with each other to avoid short circuits.

There are, in the prior art, a wide variety of approaches to the formation of a reed relay assembly of the type described above. Among these are three which are currently practiced in the art. One very inexpensive approach has been to surround the coil with a first wrap of insulative tape, bend the horns down along the tape and thereafter cover the horns with a second wrap of insulated tape. The switch leads are bent downwardly at right angles to the longitudinal axis of the bobbin and captured in slots formed in flanges projecting integrally from the bobbin. The thus formed reed relay may then be mounted on a printed circuit board, for example, with the switch leads and coil leads soldered to appropriate terminals on the printed circuit board.

A second and fairly expensive approach has been to place the switch in a bobbin with the coil wound thereon and place that assembly in a molding cavity. Thereafter, the assembly is surrounded with an epoxy, thereby completely enclosing all parts of the relay except the projecting leads.

Still another approach has been to form the bobbin with switch terminals, similar to the coil terminals formed in the bobbin. After insertion of the glass-encapsulated switch into the bobbin, the switch leads are soldered to the switch terminals, thereby immobilizing them.

Each of these approaches has its disadvantages from the standpoint of cost of labor and materials or from the standpoint of ruggedness and ability to withstand hard usage without damage.

Copending application U.S. Ser. No. 784,274, filed Apr. 4, 1977, now U.S. Pat. No. 4,136,321, is directed to the providing of an improved reed relay which is relatively inexpensive, which provides a housing for the bobbin and which effects a secure mounting of the switch in the bobbin and substantially immobilizes the switch leads, thereby preventing breakage during handling. In accordance with the invention of the copending application, the switch is inserted into a bobbin having a large hole at one end and a small opening at the other end. Thereafter, the bobbin is inserted into a housing by first threading the switch lead at the large end of the bobbin into a small slot at one end of the housing. When the housing is assembled to the bobbin, the lead projecting through the slot substantially immobilizes the lead and prevents breakage.

An objective of the present invention has been to provide a reed relay assembly including a bobbin and housing similar to that of the copending application while having the following improvements:

(a) The switch leads are more completely immobilized against moving in any direction, thereby providing greater assurance against breakage.

(b) The requirement of threading the lead through a small slot in the housing is eliminated, thereby facilitating assembly.

(c) When assembly is completed, the coil terminals and switch leads at one end of the relay are in line, thereby improving the facility with which the relay can be mounted in an electrical circuit.

(d) The switch leads are bent to their proper orientation while securely clamped, thereby providing greater assurance against breakage during the assembly process.

(e) The housing and bobbin configurations provide improvements for the purpose of ultrasonic welding of the housing to the bobbin.

The objectives of the invention are achieved and the improvements attained in part by a new bobbin and housing configuration wherein a hollow bobbin has a clamping shoulder across a small opening at one end of the bobbin and the bobbin has a hinged tab adjacent a large opening at the other end of the bobbin which, after insertion of the switch, is swung upwardly to provide a shoulder across the large opening of the bobbin. The housing has, at each end, a cooperating shoulder which clamps the switch leads against the first mentioned shoulders when the housing is assembled to the bobbin. The housing also has slots which receive the switch leads as the housing is assembled to the bobbin and hold the switch leads against lateral movement. The combined clamping of the switch leads and capture of the switch leads in the housing slots provides substantially total immobilization of the switch leads, thereby providing insurance against breakage of the somewhat fragile glass envelope.

The configuration of the bobbin is such that during assembly the bobbin is placed in a tool having upwardly projecting flanges at each end, one of which flanges swings the hinged tab upwardly into engagement with the projecting switch lead as the bobbin is placed into the tool. The configuration further is such as to permit another tool to engage the bobbin from the opposite side, thereby initially clamping the switch leads against the lower tool. Finally, a third and outer tool telescopes downwardly alongside the first mentioned tools and effects the bending of the switch leads downwardly, as well as shearing off their ends to desired length, while they are securely clamped. In this way, the bending of the switch leads is effected in such a way as to avoid any stress in the joint between the lead and the glass envelope.

The bobbin has, at each end, laterally-spaced, longitudinally-projecting blocks having transverse, vertical holes adapted to receive coil terminals which are preferably square in cross-sectional configuration. The coil terminals are oriented with respect to the switch leads at one end of the bobbin so that the terminals and switch leads lie in the same plane after completion of assembly.

The coil terminals, however, may be placed at opposite longitudinal ends of the bobbin in order to accommodate differing types of circuit mounting configurations.

As an optional feature of the invention, the bobbin and housing configuration admits of the mounting of a diode across the coil terminals where that circuit protection is desired and admits of the mounting of an electrostatic shield around the switches where that circuit feature is desired.

Another feature of the invention is that the bobbin and housing admit of the mounting of multiple switches in a single bobbin without changing the basic configuration of the bobbin or housing. The mounting of plural leads is accommodated simply by widening the bobbin and housing as required for the number of switches to be employed.

The improved ultrasonic welding is achieved by providing protuberances at each end of the housing which initially interfere with the complete assembly of the bobbin within the housing. When an ultrasonic welding horn is applied to the housing, the protuberances provide a focus for ultrasonic energy and fuse during the application of ultrasonic energy whereupon the bobbin seats completely and securely within the housing with ultrasonically-formed joints in the bobbin and housing corners.

The several objectives and features of the invention will become more readily apparent from the following detailed description in which.

Figure 1:
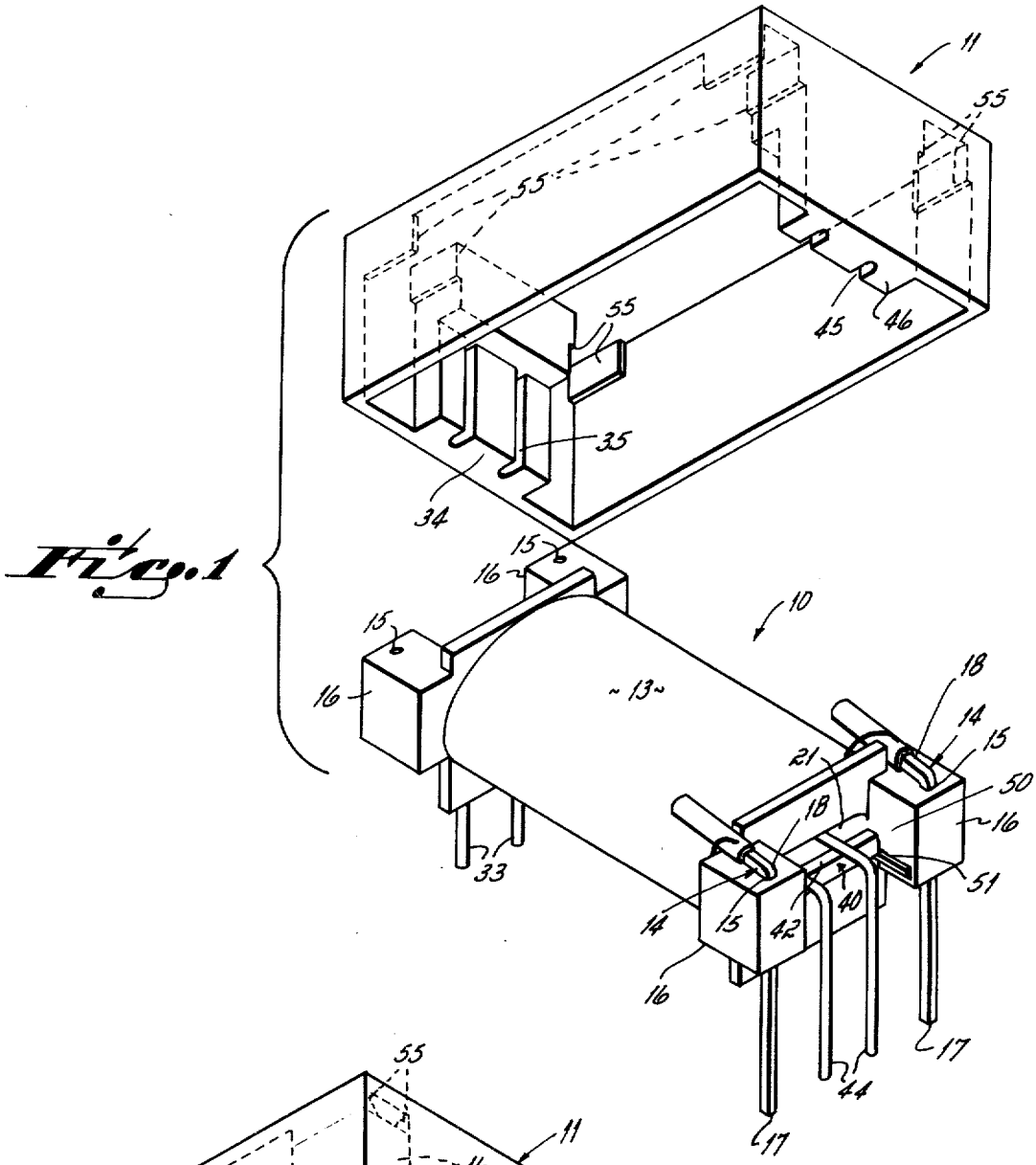
FIG. 1 is a disassembled perspective view illustrating the bobbin and housing immediately prior to assembly.

Referring to FIGS. 1-4, the reed relay of the present invention consists of a bobbin 10 enclosed by a housing 11. The bobbin has a coil 13 wound about it, the ends of the coil being connected to coil terminals 14 which are square in cross-sectional configuration and are press-fitted into bores 15 formed in blocks 16 at one end of the bobbin. The terminals 14 have projecting ends 17 extending downwardly and lying in a plane transverse to the axis of the bobbin. The opposite ends 18 of the terminals are bent over at approximately right angles and lie alongside the coil 13 on the bobbin.

Figure 5:
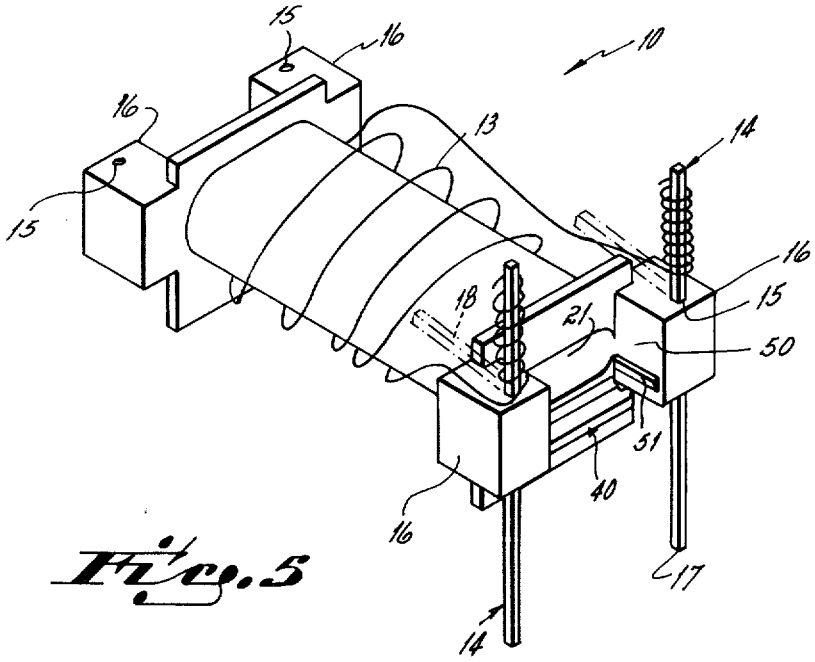
FIG. 5 is a perspective view of a bobbin formed in accordance with the present invention.

The bobbin is hollow and has a small opening 20 at one end and, when initially formed, a large opening 21 at the other end (FIG. 5). The bobbin contains a cavity 22 within which a switch or switches (two being shown) 23 are disposed. The switches are of known construction consisting of a glass envelope 24, contacts 25 and switch leads 26 projecting from the ends of the envelope, the leads being connected to the contacts 25. As is well known in the art, the contacts 25 are closed when the coil 13 is energized.

The small opening 20 is defined in part by a shoulder 30 extending transversely across the opening. The switch lead 26 projects through the opening and rests upon the shoulder 30. The housing 11 has a corresponding shoulder 32 at one end which, when the housing is in place, clamps the switch lead 26 against the shoulder 30 thereby holding it securely in place.

The switch lead is bent at right angles and projects downwardly as indicated at 33 in a position to be connected to a circuit. The housing has an integral slotted block 34 at one end, the slots 35 receiving the downwardly depending lead ends 33 to capture them securely against transverse movement such as might tend to fracture the glass envelope to which the leads are connected.

At the opposite end of the relay, the opening 21 is large enough to permit the glass envelope of the switch to pass through it into the cavity 22 within which the switch is positioned.

A tab 40 is hinged at 41 to the bobbin adjacent the open end. When the bobbin is initially molded, the tab 40 projects axially outwardly from the large opening 21 and when in that orientation, the opening 21 is large enough to permit passage of the switch through it so as to dispose the switch within the cavity 22 in the bobbin. After the switch is inserted, the tab 40 is swung upwardly to a position lying transversely across the large opening and, in that position, presents a shoulder 42 upon which the switch lead 26 rests.

At that end of the relay, the housing 11 has a corresponding shoulder 43 which is in engagement with the lead 26, clamping it against the shoulder 42 to immobilize it. The switch lead is bent downwardly as at 44 and is disposed in a vertical slot 45 formed in a block 46 integral with the end of the housing 11.

As indicated above, the bobbin has four transverse blocks 16, one block being located at each corner of the bobbin. Each block has a vertical or transverse bore 15 adapted to receive a coil terminal 14. Only two coil terminals are employed for a single coil, but these may be located at one end of the bobbin or they may be located one at each end of the bobbin, at the option of the customer, so as to adapt the relay terminals to differing circuit board configurations of the customer.

The four blocks 16 also admit of a dual coil relay wherein the two coils are wound on a bobbin and the coil leads are connected respectively to four terminals, one passing through each block 16.

Figure 6:
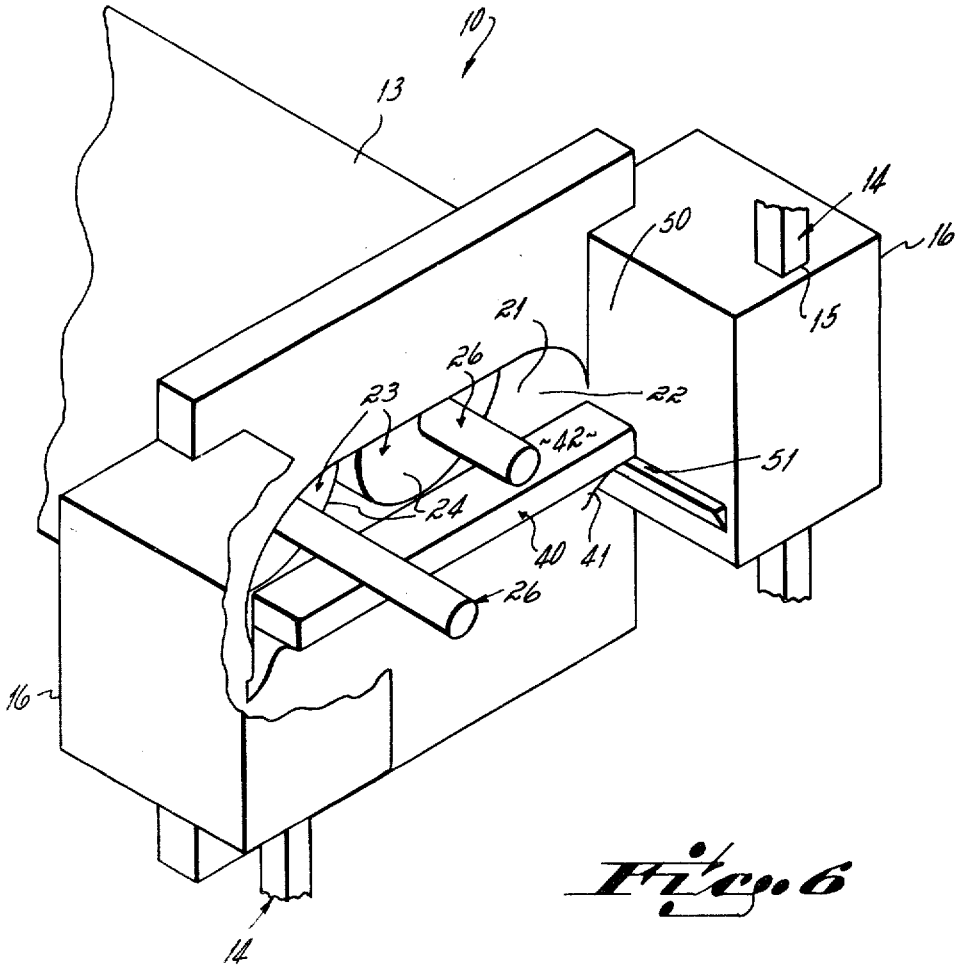
FIG. 6 is a fragmentary perspective view illustrating the hinged tab which forms a support shoulder for the switch leads.

From FIGS. 1 and 6 it can be seen that the blocks 16 and the terminals 14 project beyond the end of the bobbin, thus creating a recess 50 at each end of the bobbin. The downwardly extending portions 33, 44 of the switch leads 26 lie in the recess 50 and are located in the transverse plane of the ends 17 of the coil terminals 14, thereby facilitating their application to the circuit board.

The hinged tab 40 lies within the recess 50. Cooperating abutment or detent means 51 between the side edges of the flap 40 and the blocks 16 may be provided in order to provide assurance that the flap, when swung to its upward position across the opening 21, will remain in that position until the housing is applied. Thereafter, the housing will hold the flap 40 in its upwardly position wherein it is in clamping engagement with the leads 26 of the switch.

At each end of the housing four protuberances 55 are molded integrally into the housing. These protuberances form focal points for the ultrasonic energy which is applied to the housing and bobbin in order to securely fuse the housing to the bobbin.

Figure 7:
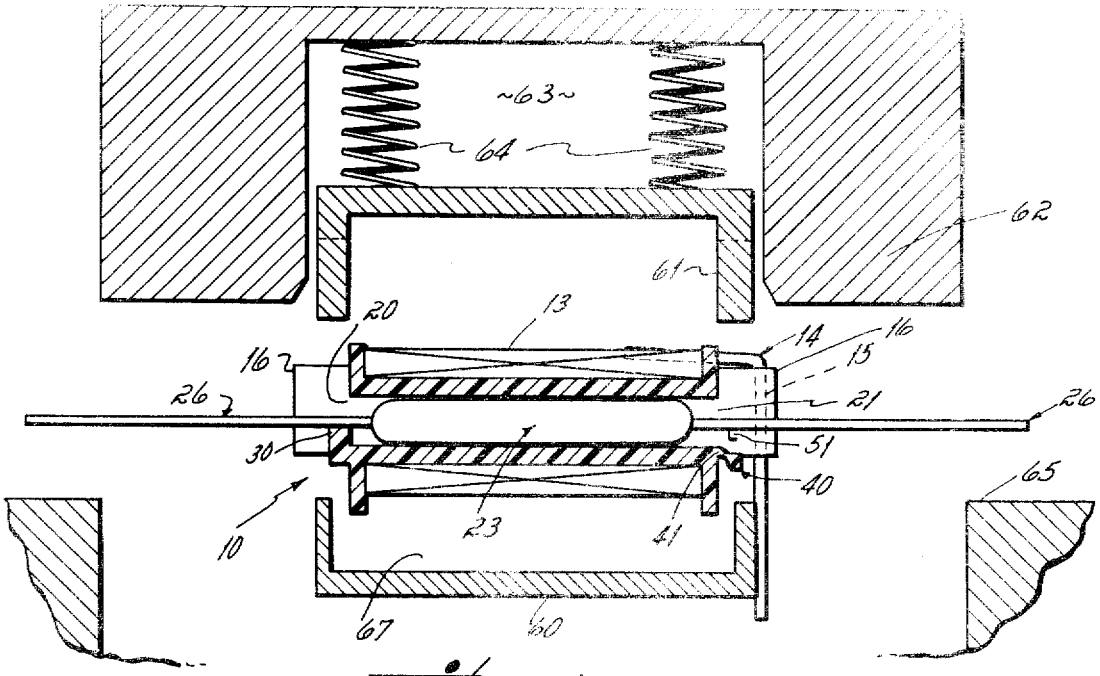
FIGS. 7-9 are diagrammatic cross-sectional views illustrating the method of assembly of the switch to the bobbin.
Figure 8:
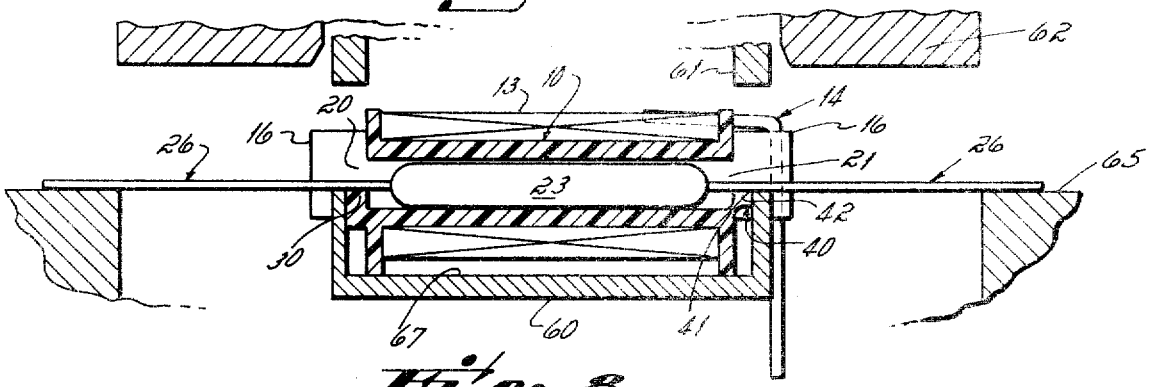
Figure 9:
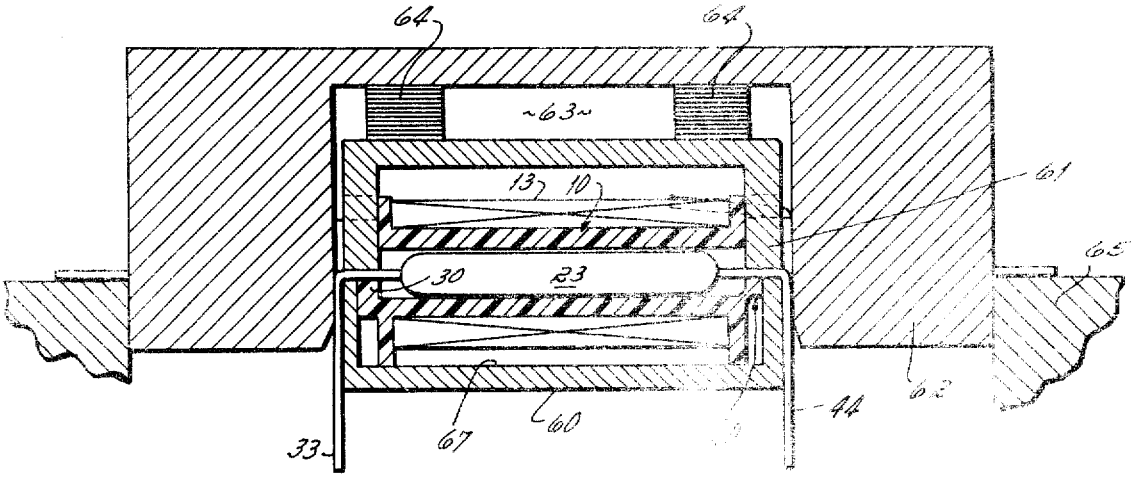

The method of assembly of the reed relay and the tools therefor are illustrated in FIGS. 7–9. The tooling includes an anvil 60, a clamp 61 and a bending die 62. The clamp 61 is mounted within a recess 63 in the bending die and compression springs 64 urge the clamp toward the anvil 60. Shearing members 65 are located at positions longitudinally spaced from the anvil and fixed with respect to the anvil. The shearing members 65 cooperate with the bending die 62 to shear the switch leads 26 to the proper length as they are being bent over into their final position.

Prior to assembly, the coil terminals 14 are inserted in the bores 15 at the ends of the bobbin. The coil is wound on the bobbin and the ends of the coil are wrapped about the terminals 14. The terminals 14 are dipped in solder to make a secure electrical connection between the coil ends and the terminals 14. Thereafter, the terminals are bent at approximately right angles to lie alongside the coil as shown in FIGS. 1 and 7.

The tab 40 as originally molded integrally with the rest of the bobbin projects longitudinally outward from the end of the bobbin leaving the large opening 21 completely open for the insertion of a switch 23.

In the assembly, the switch 23 is inserted into the cavity 22 of the bobbin 10. With the switch inserted, the bobbin is placed in a recess 67 in the anvil 60 as shown in FIG. 8. In positioning the bobbin in the avil 60, the side wall of the anvil engages the tab 40 and thrusts it upward into a position underlying and engaging the extending switch lead 26 which projects through the large opening 21. The anvil holds the tab 40 in that attitude as the remaining operations are performed.

After the bobbin is in place, the bending die 62 moves toward the anvil. As the bending die moves, the clamp 61 comes down into engagement with the switch leads and clamps them against the upper edges of the anvil 67 as well as clamping them against the shoulders 30 and 42 formed at the small and large openings of the bobbin. Continued movement of the bending die shears the switch leads by moving past the shearing members 65 and thereafter swings the switch leads downwardly through an angle of about 90°. During this bending movement of the switch leads, they are securely clamped between the clamps 61 and the anvil 60 so that the bending of the switch leads about the anvil imparts no stress at all to the joint between the switch leads and the glass envelope.

The condition of the bobbin and tooling after completion of the bending of the switch leads is shown in FIG. 9. It will be observed that the switch leads at the large end of the bobbin lie in the same plane as the projecting coil terminal ends 17 and the ends of the switch lead and the coil terminals coincide along the same line.

It will also be observed that the structure of the bobbin as well as the structure and operation of the tooling admits of the application of the invention to a bobbin carrying only a single switch as well as to a bobbin carrying multiple switches as, for example, up to six, with only a change in dimensions of the elements being required to accommodate the differing numbers of switches.

After the completion of the operation indicated at FIG. 9, the bending die 62 is raised. While the bobbin is still in the anvil with the leads in place, the housing 11 is partially applied to the bobbin so as to give the switch leads 26 a start in the slots 35, 45 of the housing. Thereafter, the bobbin is removed and the housing fully applied to it, thereby substantially totally immobilizing the switch leads. Further, as the housing is applied the shoulders 32 and 43 on the housing clamp the switch leads against the respective shoulders 30 and 42 of the bobbin so as to further complete the immobilization of the switch leads.

Figure 2:
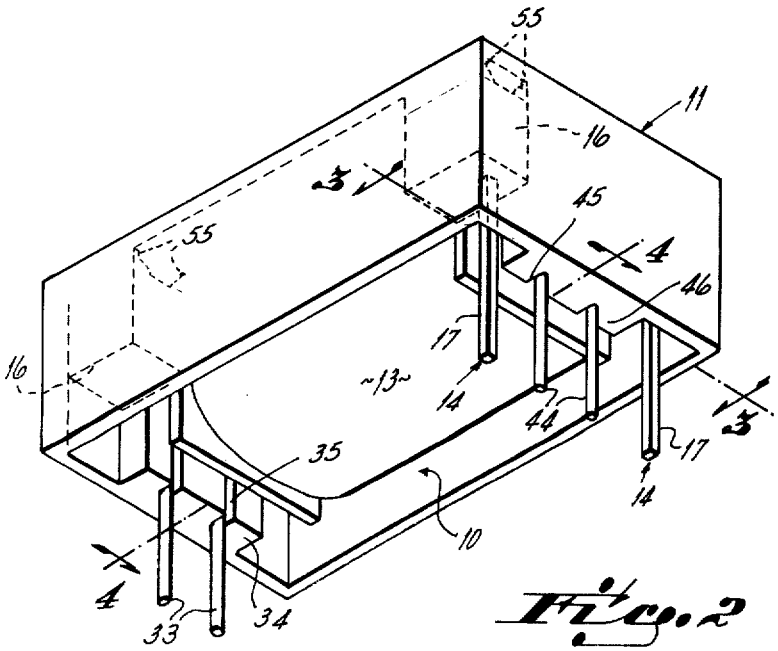
FIG. 2 is a perspective view of the reed relay following assembly.
Figure 3:
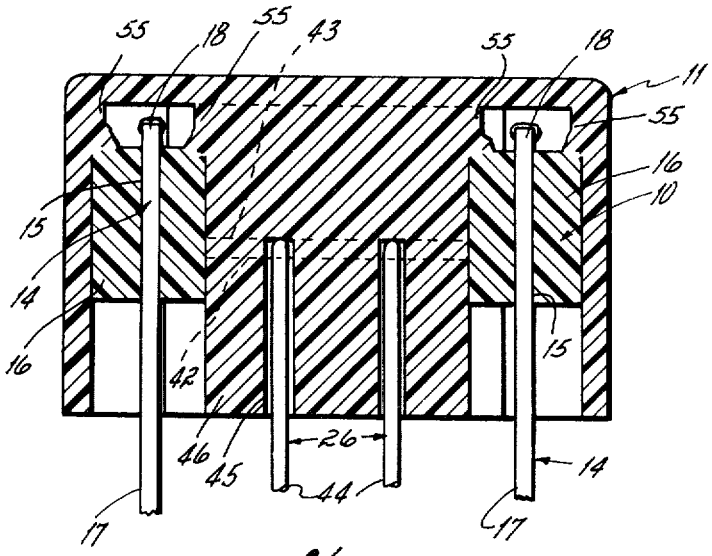
FIG. 3 is a cross-sectional view taken along lines 3—3 of FIG. 2.
Figure 4:
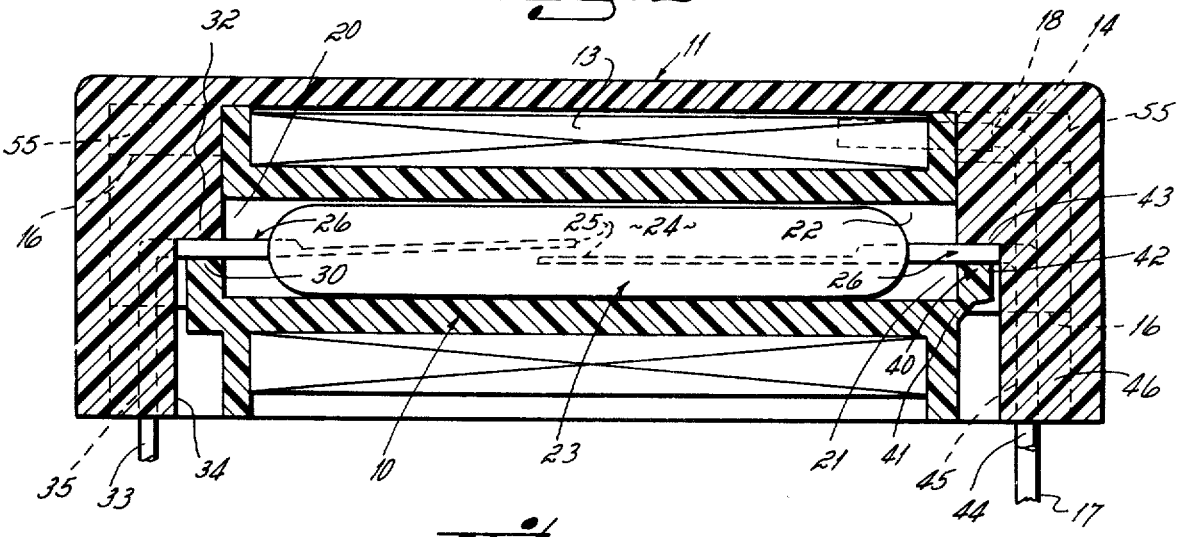
FIG. 4 is a cross-sectional view taken along lines 4—4 of FIG. 2.

When the housing is applied to the bobbin, the protuberances 55 interfere with the complete application of the housing to the bobbin. The assembly is placed in an ultrasonic welding mechanism with a welding horn applied to the housing. The application of ultrasonic energy to the thermoplastic material is focused at the points of the engagement of the protuberances with the bobbin so that at the interface between the two, a fusion takes place and the housing moves further over the bobbin until the relationship between the two is as shown in FIGS. 2, 3 and 4, thereby completing the assembly.

The configuration of the bobbin is such as to admit of the convenient placement of a diode within the confines of the bobbin, the diode being connected to the coil terminals. When the coil terminals are oriented as shown in FIG. 1, the diode may be placed in the recess 50 at the bottom portion of the bobbin with the diode leads being preferably welded to the coil terminals. If the coil terminals are positioned at the longitudinal ends of the bobbin, the diode may be placed alongside the coil with the leads thereafter welded to the coil terminals.

The invention also admits of the wrapping of the switch with an electrostatic shield. In the optional feature of the invention, prior to insertion of the switch into the bobbin, it is wrapped with an electrostatic shield and a lead projecting from the shield. The shield and switch are then inserted into the bobbin with the shield lead projecting from the large end of the bobbin. The shield lead is then wrapped around the terminal pin which is to be connected to ground and soldered onto it prior to the bending of the terminal pin alongside the bobbin.

I claim:

1. A reed relay comprising, a hollow bobbin having a large opening at one end and a small opening at the other end, at least one switch enclosed in a glass envelope and having leads projecting from both ends, said switch being inserted into said bobbin with leads projecting through said openings, said small opening including a transverse shoulder upon which said projecting lead rests, said bobbin having a tab hinged across said large opening and adapted to swing up into position to provide a shoulder across said large opening upon which said projecting lead rests, said hinged tab thereby permitting a large opening for switch insertion while providing a lead supporting shoulder after said switch has been inserted into said bobbin, and a housing for said bobbin.

2. A reed relay as in claim 1 in which said housing has a shoulder at each end, said shoulders engaging the switch leads and clamping them against said bobbin shoulders to immobilize said leads and protect against fracture of said glass envelope.

3. A reed relay as in claim 1 further comprising, a coil surrounding said bobbin, two terminals embedded in one end of said bobbin and having ends projecting perpendicularly to the axis of said bobbin, the other ends being bent to lie alongside said bobbin and being connected to said coil, the switch lead adjacent said terminals being bent to lie in the same plane as said projecting terminal ends.

4. A reed relay as in claim 1, said housing and bobbin being of thermoplastic materials, said housing having interfering protuberances at its internal corners engageable by said bobbin, said protuberances fusing when said bobbin and housing assembly are subjected to ultrasonic welding.

5. A reed relay as in claim 1 in which said housing has an integral block at each end, and slots in said block to receive said terminal leads.

6. A reed relay as in claim 1 in which said hinge and bobbin opening have cooperating detent means to hold said tab in its position across said opening.

7. A reed relay as in claim 1 further comprising, transverse blocks projecting longitudinally from the corners of said bobbin, said blocks creating a recess therebetween, said tab being located between two of said blocks at one end of said bobbin.

8. A reed relay as in claim 7 further comprising, abutment means between said tab and said blocks to hold said tab across said large opening.

9. A reed relay as in claim 1 further comprising, transverse blocks projecting from the corners of said bobbin, said blocks creating a recess between adjacent blocks, said recess being adapted to receive a diode without interfering with the application of said housing.

10. The method of making a reed relay assembled from a hollow bobbin having a tab hinged across one open end thereof, a switch having leads projecting from each end, and a housing having shoulders at each end, comprising the steps of:

inserting a switch in said bobbin through said open end, swinging said tab across said open end to provide support for a projecting switch lead, bending said switch lead downwardly, applying said housing to said bobbin to clamp said switch lead between said housing shoulder and said tab.

11. The method as in claim 10 in which a single tool thrusts said hinged tab into position and thereafter forms a support for the bending of said switch lead.

12. The method as in claim 10 further comprising the step of shearing the ends of said switch leads to a desired length at the beginning of said bending step.

* * * * *